US012808640B2

(12) United States Patent
Searle

(10) Patent No.: US 12,808,640 B2
(45) Date of Patent: Nov. 24, 2026

(54) LIMITED RANGE LOW TERMINAL VELOCITY PROJECTILE

(71) Applicant: Slow Shot, LLC, Tarpon Springs, FL (US)

(72) Inventor: Matthew Searle, Tarpon Springs, FL (US)

( * ) Notice: Subject to any disclaimer, the term of this patent is extended or adjusted under 35 U.S.C. 154(b) by 0 days.

(21) Appl. No.: 19/321,412

(22) Filed: Sep. 8, 2025

(65) Prior Publication Data

US 2026/0071858 A1 Mar. 12, 2026

Related U.S. Application Data

(60) Provisional application No. 63/692,894, filed on Sep. 10, 2024.

(51) Int. Cl.
*F42B 10/50* (2006.01)
*F42B 10/14* (2006.01)

(52) U.S. Cl.
CPC ..... *F42B 10/50* (2013.01); *F42B 10/14* (2013.01)

(58) Field of Classification Search
CPC ..... F42B 10/50; F42B 10/54; F42B 10/26; F42B 10/48; F42B 10/58; F42B 10/14
See application file for complete search history.

(56) References Cited

U.S. PATENT DOCUMENTS 4,063,515 A * 12/1977 Schneider, Jr. ..... F42B 10/26 102/505
5,088,414 A * 2/1992 Vesa ..... F42B 10/50 102/388
5,155,294 A * 10/1992 Vesa ..... F42B 10/16 244/3.28
5,280,752 A * 1/1994 Borgstrom ..... F42B 10/50 102/388
5,282,422 A * 2/1994 Borgstrom ..... F42B 10/50 102/388
8,794,156 B1 8/2014 Smith
2015/0323296 A1* 11/2015 Rastegar ..... F42B 4/26 102/342

FOREIGN PATENT DOCUMENTS

EP 0305040 A1 * 3/1989 ..... F42B 10/14

* cited by examiner

*Primary Examiner* — Jonathan C Weber
(74) *Attorney, Agent, or Firm* — Lewellyn Law, PLLC; Stephen Lewellyn

(57) ABSTRACT

A projectile and ammunition round are provided for disabling unmanned aerial vehicles (UAVs) or drones while reducing risks to people and property on the ground. The projectile includes a penetrator body and a plurality of wings that are folded during firing and deploy after discharge. In the deployed configuration, the wings slow and stabilize the projectile by generating drag and imparting rotation. The body may include grooves and a recessed forward end to enable multiple projectiles to be stacked in a nested configuration within a casing. An ammunition round may contain multiple stacks of the projectiles for compact storage and sequential deployment.

17 Claims, 7 Drawing Sheets

LIMITED RANGE LOW TERMINAL VELOCITY PROJECTILE

CROSS-REFERENCE TO RELATED APPLICATIONS

This application claims the benefit of Provisional Patent Application Ser. No. 63/692,894, filed Sep. 10, 2024, the entirety of which is incorporated herein by reference.

FIELD OF THE INVENTION

The present invention relates generally to projectiles and ammunition, and more particularly to projectiles configured for disabling unmanned aerial vehicles (UAVs) or drones while reducing risks to people and property on the ground, including ammunition rounds containing such projectiles.

BACKGROUND OF THE INVENTION

The rapid proliferation of unmanned aerial vehicles (UAVs), commonly referred to as drones, has created new challenges relating to public safety and airspace management. Drones are increasingly used for commercial, recreational, governmental, and even malicious purposes. While drones can provide significant benefits, including aerial photography, package delivery, and infrastructure inspection, their presence in sensitive areas or over populated environments can create risks that necessitate defensive action. In circumstances where a drone poses a hazard, law enforcement, security personnel, or military may seek to disable or remove the drone from flight.

One of the most direct approaches to disabling a drone is to shoot it down using conventional firearms and ammunition. While this method may be effective in striking the aerial target, it introduces significant collateral risks. Traditional ammunition is designed to penetrate targets with substantial force and, when fired into the air, those projectiles eventually return to the ground at high velocity. The falling bullets pose a serious danger to individuals, property, and vehicles located below the engagement area. Numerous reports and studies have confirmed that stray bullets, even when descending, can cause severe injury or death. Thus, the use of live ammunition in urban or populated environments to neutralize drones creates a public safety dilemma.

The risk of injury from falling bullets is compounded by the unpredictable dynamics of aerial engagements. When a drone is targeted, the shooter may need to aim upward at various angles. Depending on the trajectory, a projectile may travel a considerable distance beyond the immediate area of engagement before descending. This makes it difficult, if not impossible, to predict precisely where the bullet will land. Even if the drone is successfully struck, the fired bullet, as well as fragments from both the bullet and the disabled drone, may descend in uncontrolled patterns, creating hazards to bystanders.

In addition to risks posed by the bullets themselves, the use of conventional ammunition raises concerns about over-penetration and ricochet. Standard rounds are designed for effectiveness against hardened or biological targets, and when fired at a lightweight aerial device such as a drone, they may pass through with little reduction in velocity. As a result, the bullet may continue traveling until it strikes an unintended surface or object, potentially causing further damage or injury. In urban or sensitive environments, these secondary risks make the use of traditional firearm ammunition particularly problematic.

These safety issues are not merely theoretical. Law enforcement agencies have faced public criticism and liability concerns when stray rounds have resulted in injuries during aerial target engagements. Moreover, municipalities and regulatory bodies increasingly restrict the discharge of firearms in populated areas due to these risks. Accordingly, there exists a recognized need for alternatives to conventional bullets when attempting to disable drones in scenarios where public safety must be maintained.

The dangers associated with falling ammunition underscore the inadequacy of conventional projectiles for this purpose. While the threat posed by rogue or unauthorized drones may justify decisive action, the countermeasure itself should not introduce a comparable or greater threat to people and property on the ground. A safer, more controlled approach is necessary to reconcile the competing needs of drone defense and civilian protection.

SUMMARY OF THE INVENTION

The present invention is directed to projectiles and ammunition systems for disabling unmanned aerial vehicles (UAVs) or drones while mitigating the dangers posed by conventional ammunition. More particularly, the invention provides a projectile that can be discharged from a firearm or launching device to disable a drone in flight, while incorporating structural features that reduce the risk of injury or property damage from the projectile's return to the ground.

In general, the projectile includes a penetrator body and a plurality of deployable wings. The wings are stowed in a folded configuration during firing and unfurl to an extended configuration after discharge. In the extended configuration, the wings act to decelerate the projectile and impart rotational motion to the penetrator body, thereby slowing and stabilizing its descent.

In one embodiment, the penetrator body includes a forward end of greater diameter than a rearward end, the forward end defining a recess configured to receive the reduced-diameter rearward end of another projectile. The body further includes a plurality of longitudinal grooves formed around its circumference for receiving elongated arm portions of wings from an adjacent projectile. These structural features allow multiple projectiles to be stacked and nested together in a stable configuration.

Each wing may include an elongated arm portion attached to the body and a widened blade portion at the distal end of the arm. The blade portion is contoured to increase aerodynamic drag and to induce autorotation of the penetrator body during descent. The wings may be overmolded to the body, thereby providing a robust attachment and permitting different materials to be used for the penetrator body and the wings.

In another embodiment, an ammunition round includes a casing housing a plurality of the projectiles in stacked and nested arrangements. For example, three stacks of three projectiles may be positioned within a single round, with each projectile interlocking through both the recess-and-rearward-end engagement and the groove-and-arm engagement. This arrangement permits efficient use of space, secure alignment of projectiles, and reliable sequential deployment.

Accordingly, the present invention provides an effective countermeasure against drones, combining disabling capability with improved safety during descent. The structural configuration of the projectile and ammunition system enables compact packaging, controlled flight dynamics, and reduced ground-level hazards.

In an aspect, the disclosure provides a projectile that can be fired from a firearm or launching device, such as a shotgun or similar casing, to disable an airborne drone. The projectile has a body with a forward end and a rearward end. In some forms, the forward end is wider than the rearward end, and the forward end may include a recess. The recess is sized to receive the smaller rearward end of another projectile so that multiple projectiles can be stacked in a nested arrangement.

In aspects, the body may also include grooves formed along its outer surface. The grooves may extend longitudinally from the forward end toward the rearward end. These grooves can receive portions of the wings from an adjacent projectile, further supporting the ability to nest and stack multiple projectiles securely.

In aspects, the projectile includes a set of wings attached around the body. The wings are folded against the body when the projectile is stored in a casing and when first discharged. After the projectile has traveled a distance in flight, the wings unfurl outward into an extended configuration. Each wing may include an elongated arm that runs along the body and a widened blade at its outer end. The widened blade is shaped to catch air, generate drag, and cause the projectile to rotate. This autorotation and drag slow the projectile's descent to the ground, reducing the risk of injury or property damage. The wings may be overmolded to the body for strength, may be aeroelastic so that they flex under aerodynamic loads, and may be shaped in various ways to control drag and rotation. In some examples, three equally spaced wings are used, although more or fewer wings, or wings with uneven spacing, may be provided.

In aspects, the disclosure also provides an ammunition round that contains multiple projectiles within a casing. In one example, three stacks of at least two projectiles each are arranged in a triangular pattern within the casing. A sabot may be positioned within the casing to assist in propelling the projectiles upon discharge. The sabot may have a plurality of nubs extending toward the projectiles, the nubs being positioned between folded wings of the projectiles and configured to contact rearward ends of the penetrator bodies so as to transmit firing force through the penetrator bodies.

In aspects, the ammunition round may include different numbers of stacks, and each stack may have more or fewer projectiles than the illustrated examples. Multiple arrays of stacks may also be used within a casing, separated by a sabot or other spacer. The stacks may be arranged in triangular, linear, or other configurations as desired.

In aspects, in operation, when the ammunition round is fired, the sabot pushes the projectiles out of the casing. The projectiles initially travel with their wings folded, enabling stable flight toward a drone target. Some projectiles may strike and disable the drone, while others continue beyond the drone. After a short effective range, the wings unfurl into the extended configuration, causing drag and autorotation, and ensuring that the projectiles return to the ground at a reduced and safer velocity.

Numerous additional objects, features, and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception upon which this disclosure is based may readily be utilized as a basis for the designing of other structures, methods, and systems for carrying out the several purposes of the present invention.

For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings.

DETAILED DESCRIPTION

The present disclosure relates to a projectile and an associated ammunition round for disabling unmanned aerial vehicles (UAVs) or drones while reducing risks to people and property on the ground.

Figure 1:
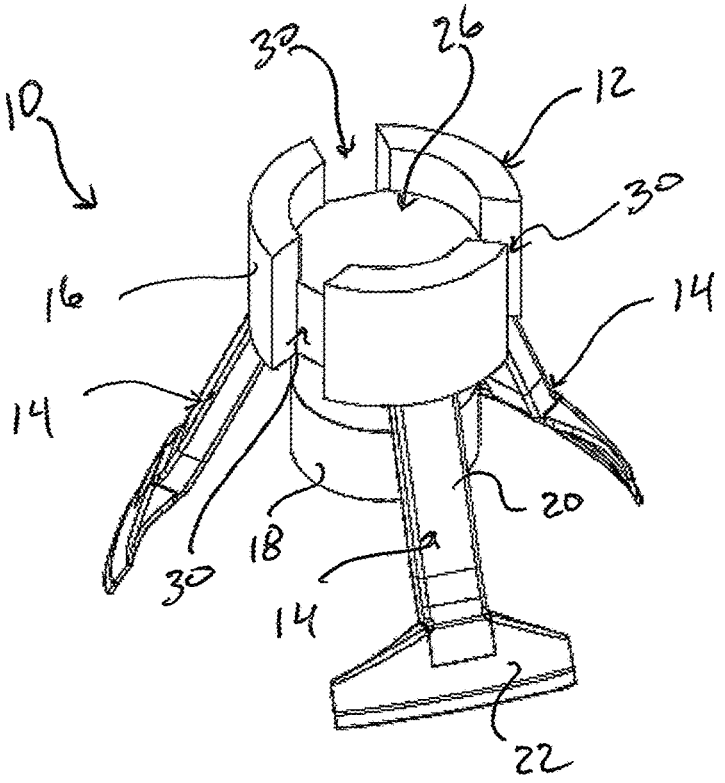
FIG. 1 is a perspective view of a projectile with wings in an unfurled configuration.
Figure 2:
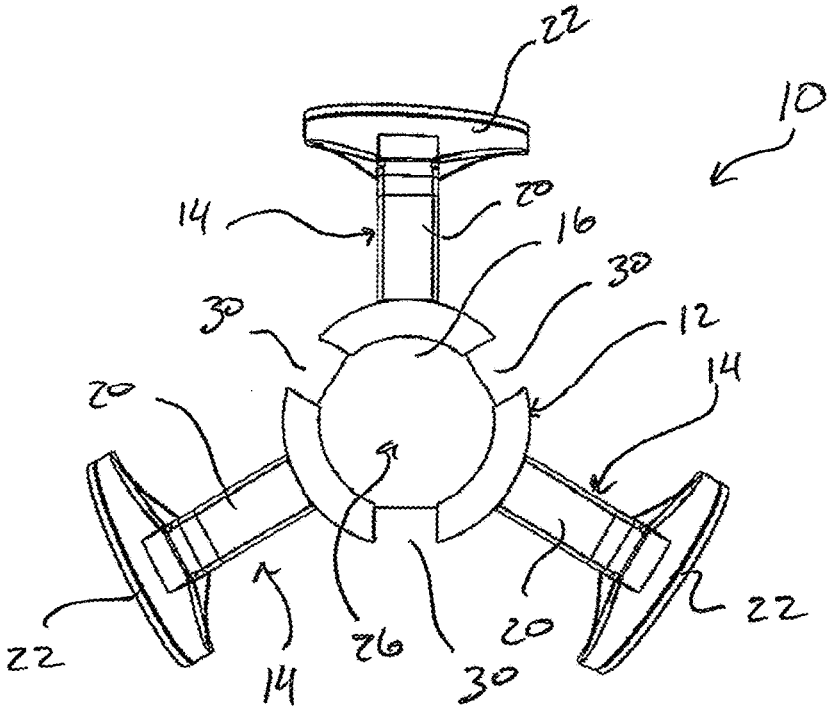
FIG. 2 is a top view of the projectile of FIG. 1 with wings in an unfurled configuration.
Figure 3:
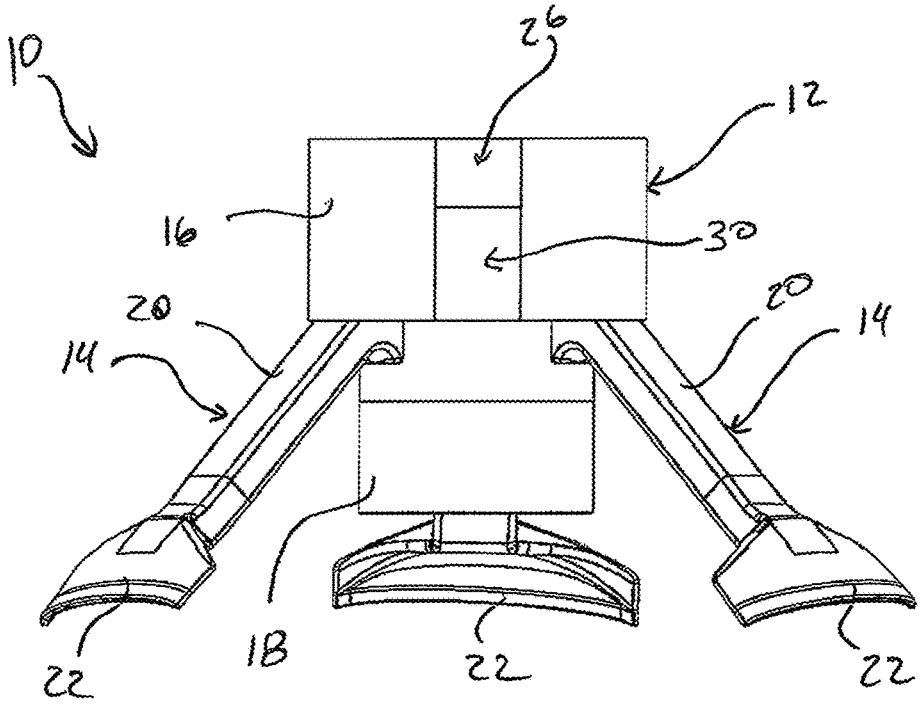
FIG. 3 is a side elevation view of the projectile of FIG. 1 with wings in an unfurled configuration.

Referring now to FIG. 1-3, a projectile 10 is illustrated in perspective, top, and side elevation views, respectively, with wings in an unfurled configuration. Broadly, projectile 10 is configured to be discharged from a firearm or launching device to impact and disable an airborne drone while reducing hazards associated with uncontrolled descent. The projectile 10 includes a penetrator body 12 and a plurality of wings 14 extending outwardly from the body 12. In the unfurled configuration shown, the wings 14 act to increase aerodynamic drag and impart rotational motion to the body 12, thereby slowing and stabilizing the projectile 10 during its return to the ground.

The body 12 is generally cylindrical in shape and extends along a longitudinal axis between a first, forward end 16 and an opposite, second, rearward end 18. The forward end 16 has a greater diameter than the rearward end 18, giving the body 12 a stepped profile. This shape contributes to both aerodynamic balance and the ability of the projectile 10 to interlock with adjacent projectiles in a stacked configuration, as described further below. The body 12 may be formed of a dense or hardened material capable of damaging drone components, while alternative materials may be employed to adjust mass, strength, or manufacturing cost.

Figure 4:
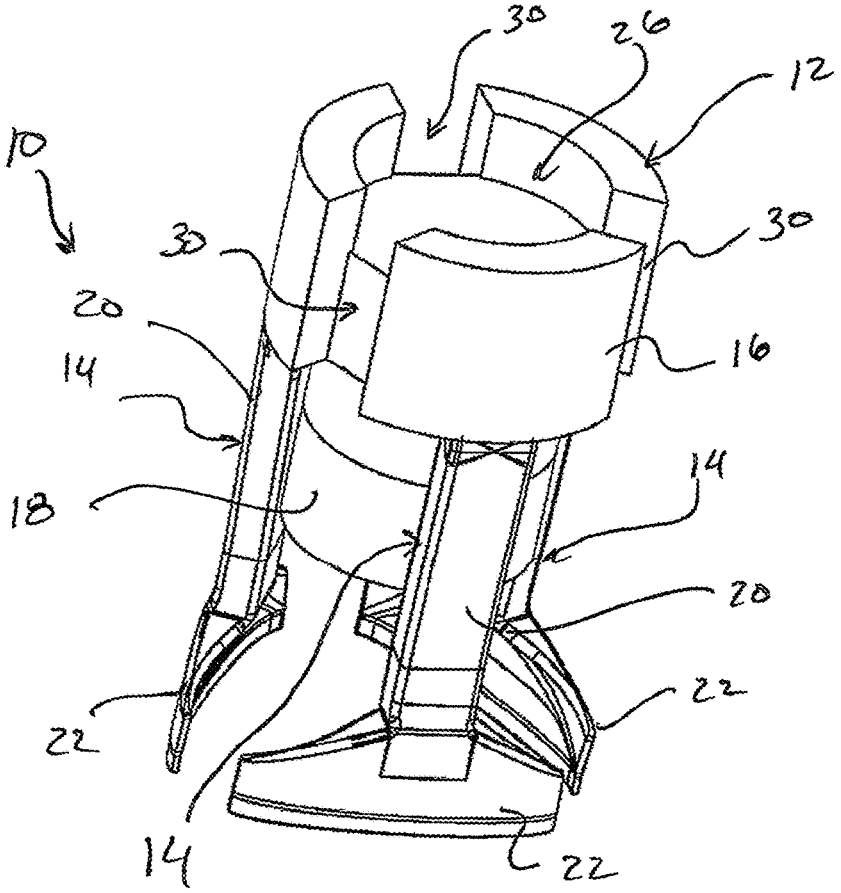
FIG. 4 is a top perspective view of the projectile with wings in a folded configuration.
Figure 5:
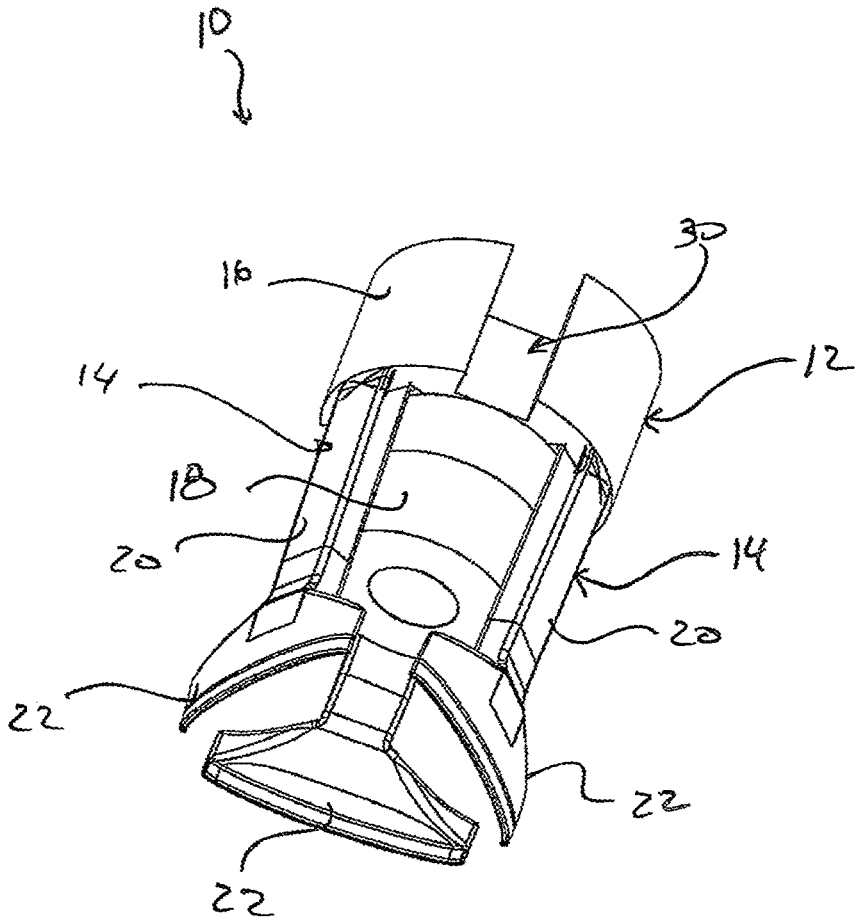
FIG. 5 is a bottom perspective view of the projectile with wings in a folded configuration.

A plurality of wings 14 are circumferentially spaced around the body 12. More particularly, the wings 14 are attached to the narrower-diameter portion of the body 12 adjacent the step between the forwarded end 16 and the rearward end 18. In the stored condition, the wings 14 are folded against the body 12, as shown in FIGS. 4 and 5, allowing the projectile 10 to be compactly stacked within an ammunition casing and to travel along a stable ballistic path immediately after discharge, described further below. After a period of flight, the wings 14 unfurl outwardly into the extended configuration shown in FIG. 1-3.

In certain embodiments, the wings 14 are aeroelastic, meaning they are configured to flex, bend, or twist in response to aerodynamic forces. This property allows wings 14 to remain stowed during initial travel, yet to deploy and deform beneficially under aerodynamic load to increase drag and induce autorotation. In some aspects, wings 14 may be overmolded onto the body 12, which provides a secure structural connection and permits wings 14 to be formed of a material different from that of the body 12. For example, the body 12 may be metallic for strength and impact resistance, while the wings 14 may be a thermoplastic elastomer, plastic, polymeric or composite to optimize aeroelastic response and deployment reliability.

In aspects, the wings 14 may be overmolded onto the body with the wings in the unfurled position. The wings collapsed into the folded position for loaded into an ammunition casing. After firing, the wings recover to the unfurled position as aerodynamic force decreases with slowing velocity of the projectile.

Each wing 14 includes an elongated arm portion 20 extending outwardly from the body 12 and terminating in a widened blade portion 22. The arm portion 20 serves as the structural link to the body 12, while the blade portion 22 is shaped and contoured to increase drag and induce autorotation once the wings 14 are deployed. The combined effect of drag and autorotation reduces terminal velocity and stabilizes the descent of the projectile 10, thereby mitigating risks to people and property while maintaining effectiveness in disabling an airborne target.

Although the wings 14 are shown as including elongated arm portions 20 terminating in widened blade portions 22, in some embodiments, the wings may be formed as straight arms without a widened blade portion. Such wings may still be configured to unfurl from a stowed configuration and generate aerodynamic drag, induce autorotation, or otherwise decelerate the projectile 10 during descent. The particular shape, thickness, or contour of the wings 14 may therefore vary depending on design preferences or performance requirements.

Although the projectile 10 is with three wings 14 equally spaced around the body 12, the invention is not limited to this configuration. In alternative embodiments, the projectile 10 may include more or fewer wings depending on desired aerodynamic properties. In some aspects, the wings 14 may be arranged asymmetrically or at varying angular intervals around the body 12 to alter drag characteristics, spin rate, or flight stability.

In some embodiments, the projectile 10 may be designed to have a relatively short effective range prior to wing deployment. For example, the wings 14 may remain folded during the initial portion of flight, permitting the projectile 10 to travel a distance of approximately 50 yards or less with sufficient velocity to strike a drone. After that range, the wings 14 unfurl into the extended configuration, thereby decelerating and stabilizing the projectile 10 for its descent. This arrangement allows the projectile 10 to remain effective against aerial targets while reducing the risk of injury or damage from uncontrolled ground impact.

Referring now to FIGS. 4 and 5, projectile 10 is shown with the wings 14 in a folded or stowed configuration. In this condition, the wings 14 lie closely along the body 12, permitting compact storage and efficient stacking of multiple projectiles within a casing, as described in more detail below. The folded arrangement also presents a streamlined profile for stable initial flight upon discharge.

FIG. 4 depicts a top perspective view emphasizing the forward end 16 of the generally cylindrical body 12, which has a greater diameter than the rearward end 18. A recess 26 is formed at the forward end 16 and is configured to receive the rearward end 18 of another projectile, enabling a nested stacking arrangement as described further below. Grooves 30 are formed in the outer surface of the body 12 at the forward end 16 and extend longitudinally toward the rearward end 18.

As shown, wings 14 are circumferentially positioned between adjacent grooves 30 when in the stowed state.

FIG. 5 provides a bottom perspective view. In this view, the wings 14 are seen lying in interstitial regions between the grooves 30, with elongated arm portions 20 extending generally parallel to the longitudinal axis of body 12. The placement of the wings 14 between the grooves 30 facilitates a complementary fit with an adjacent projectile during stacking—while the detailed stacking interaction is described in connection with later figures—thereby supporting a compact, aligned array within a casing.

In this folded configuration, the projectile 10 may be loaded into an ammunition casing as part of a stacked array, with the recess 26 and grooves 30 cooperating as described in more detail below.

Although projectile 10 is shown with three grooves 30 equally spaced around the body 12, the invention is not limited to this arrangement. In alternative embodiments, the number of grooves 30 may be increased or decreased depending on the number and placement of wings 14, the desired stacking geometry, or manufacturing considerations. In some aspects, the grooves 30 may also be arranged asymmetrically or at non-uniform intervals to accommodate variations in wing design or to alter stacking relationships between adjacent projectiles.

Figure 6:
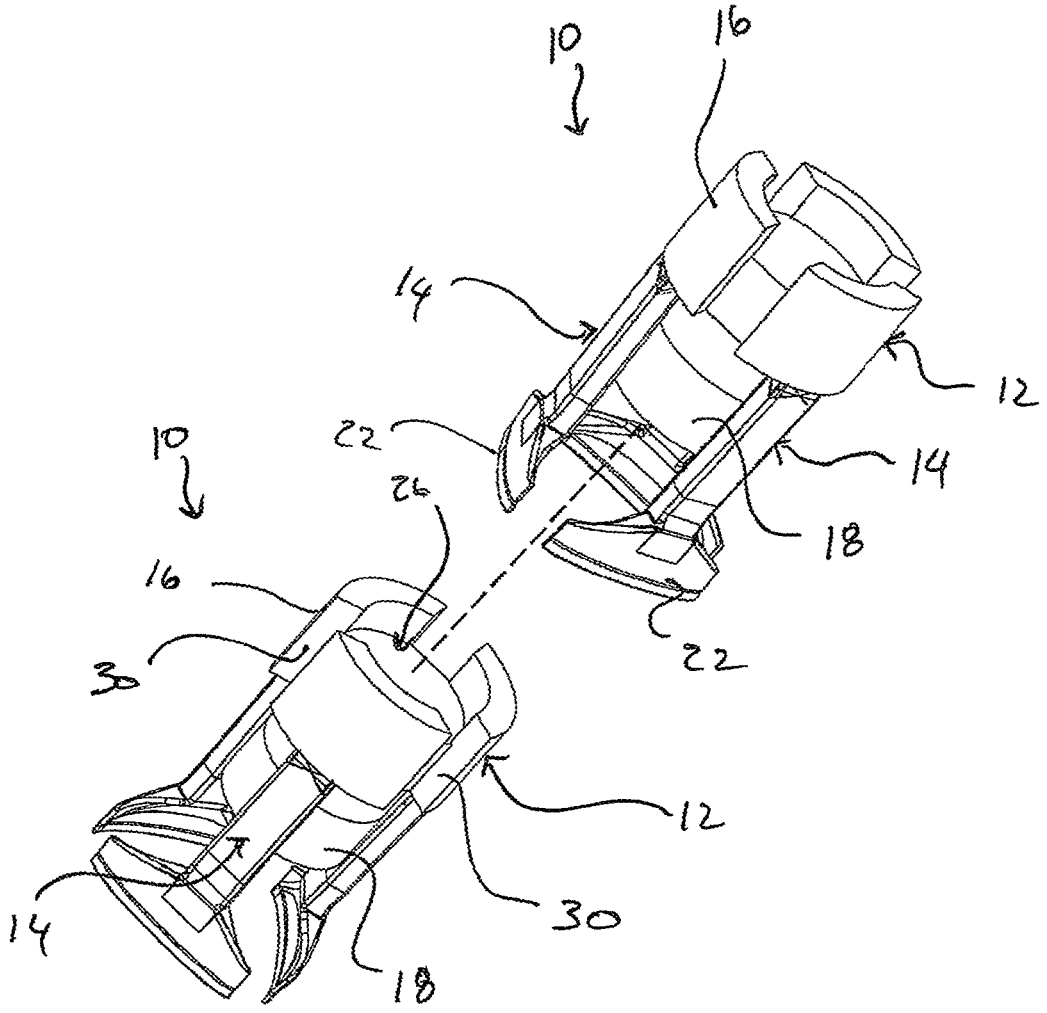
FIG. 6 is a perspective view of two projectiles spaced apart along a common axis to illustrate stacking engagement.

Referring now to FIG. 6, two projectiles 10 are illustrated in a spaced-apart, exploded arrangement along a common axis to demonstrate the manner in which they interfit when stacked. The rearward end 18 of a first projectile 10 is received within the recess 26 formed in the forward end 16 of a second projectile 10. This body-to-body engagement provides axial alignment and stability when multiple projectiles are arranged in series.

In addition, the elongated arm portions 20 of the wings 14 on the first projectile 10 are positioned to be received within the grooves 30 formed in the body 12 of the second projectile 10. This complementary relationship between wings 14 and grooves 30 allows adjacent projectiles to nest securely together while maintaining compact spacing.

The reduced diameter of the rearward end 18 further provides clearance around the body 12 of the second projectile 10 for accommodating the blade portions 22 of the wings 14. This configuration ensures that when multiple projectiles are stacked, the blade portions 22 do not interfere with one another but instead are positioned within available space around the narrower rearward end 18 of an adjacent projectile.

Together, the recess 26, grooves 30, and stepped profile of the body 12 enable reliable stacking of multiple projectiles in a compact and aligned configuration, as will be further described below in connection with additional figures.

Figure 7:
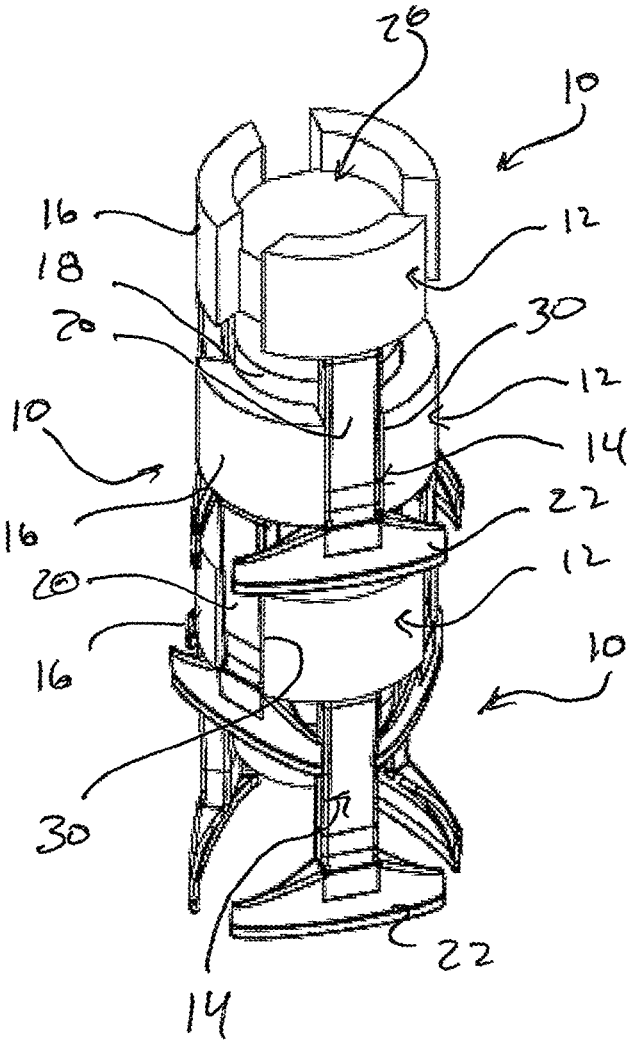
FIG. 7 is a perspective view of three projectiles stacked together in a nested configuration.

Although FIG. 7 illustrates three projectiles 10 stacked together, the number of projectiles in a stack is not limited to this example. In alternative embodiments, at least two projectiles may be stacked in the manner described, or more than three projectiles may be stacked depending on the dimensions of the body 12, the wings 14, and the intended ammunition casing.

Figure 8:
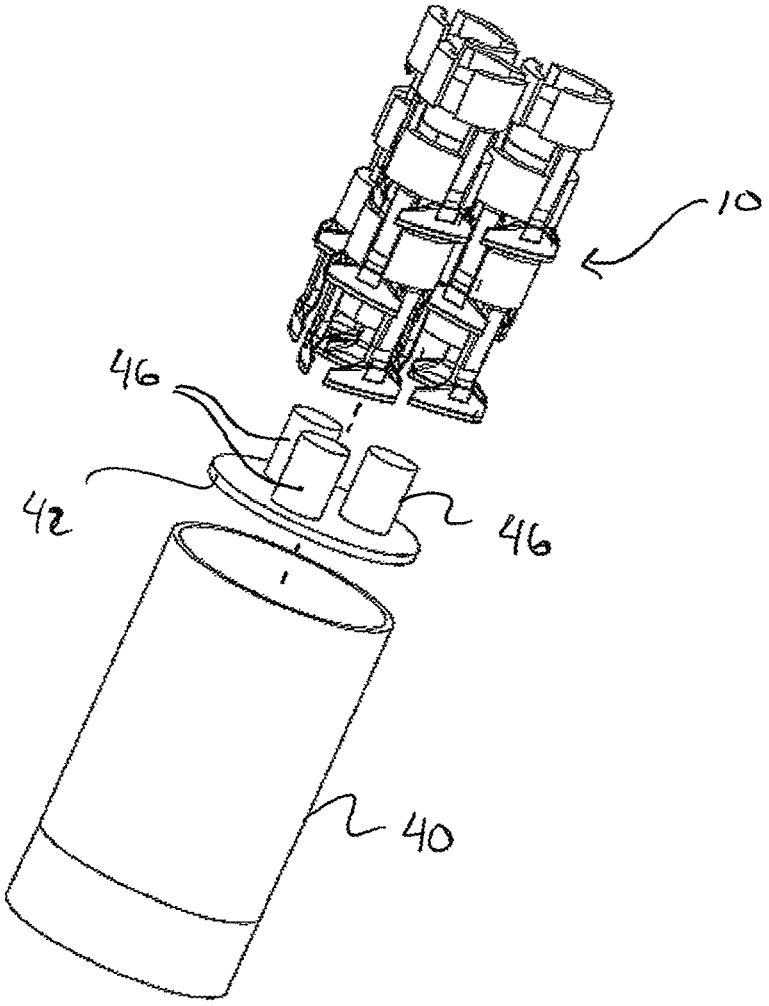
FIG. 8 is an exploded perspective view of an ammunition round including a casing, a sabot, and multiple stacks of projectiles.

Referring now to FIG. 8, an ammunition assembly is illustrated in an exploded perspective view to show the arrangement of its components. The assembly includes a casing 40, which is representatively shown as a shotgun casing but may be formed as other types of casings depending on the intended firearm or launching device.

Positioned within the casing 40 is a sabot 42. In the illustrated embodiment, the sabot 42 is representatively shown as a narrow disc, but other forms and constructions of sabots may be used. The sabot 42 includes a plurality of nubs 46 extending forwardly. The nubs 46 are configured to be positioned in spaces between the folded wings 14 of the projectiles 10 and to contact the rearward ends 18 of the penetrator bodies 12. This arrangement ensures that, upon firing, the propulsive force of the sabot 42 is transmitted directly to the penetrator bodies 12 rather than through the wings 14, which might otherwise deform under the load.

Next, an array of projectiles 10 is shown. In the embodiment illustrated, the array includes three stacks of projectiles, with each stack containing three projectiles 10. The stacks are oriented parallel to one another and arranged in a generally triangular configuration to maximize packing density within the casing 40. Each projectile 10 in a stack interfits with its neighbors as previously described with respect to FIGS. 6 and 7, using the recess 26, grooves 30, and reduced-diameter rearward ends 18 to nest securely together.

Although FIG. 8 illustrates three stacks of three projectiles arranged in a triangular configuration, the invention is not limited to this arrangement. In alternative embodiments, the number of stacks may be fewer or greater than three, and the number of projectiles per stack may vary depending on the dimensions of the projectiles and the casing. The stacks may also be arranged in alternative patterns, such as linear or square configurations, depending on the desired ammunition capacity and geometry of the casing.

In further embodiments, multiple arrays of stacks may be provided within a single casing. For example, a first array may include three stacks, each having two or more projectiles, and a second array may also include three stacks, each having two or more projectiles. A second sabot or similar structure may be positioned between the arrays to separate and stabilize them. Additional arrays and separating structures may be employed as desired, permitting the ammunition configuration to be modified to suit performance requirements, casing size, or design preferences.

Figure 9:
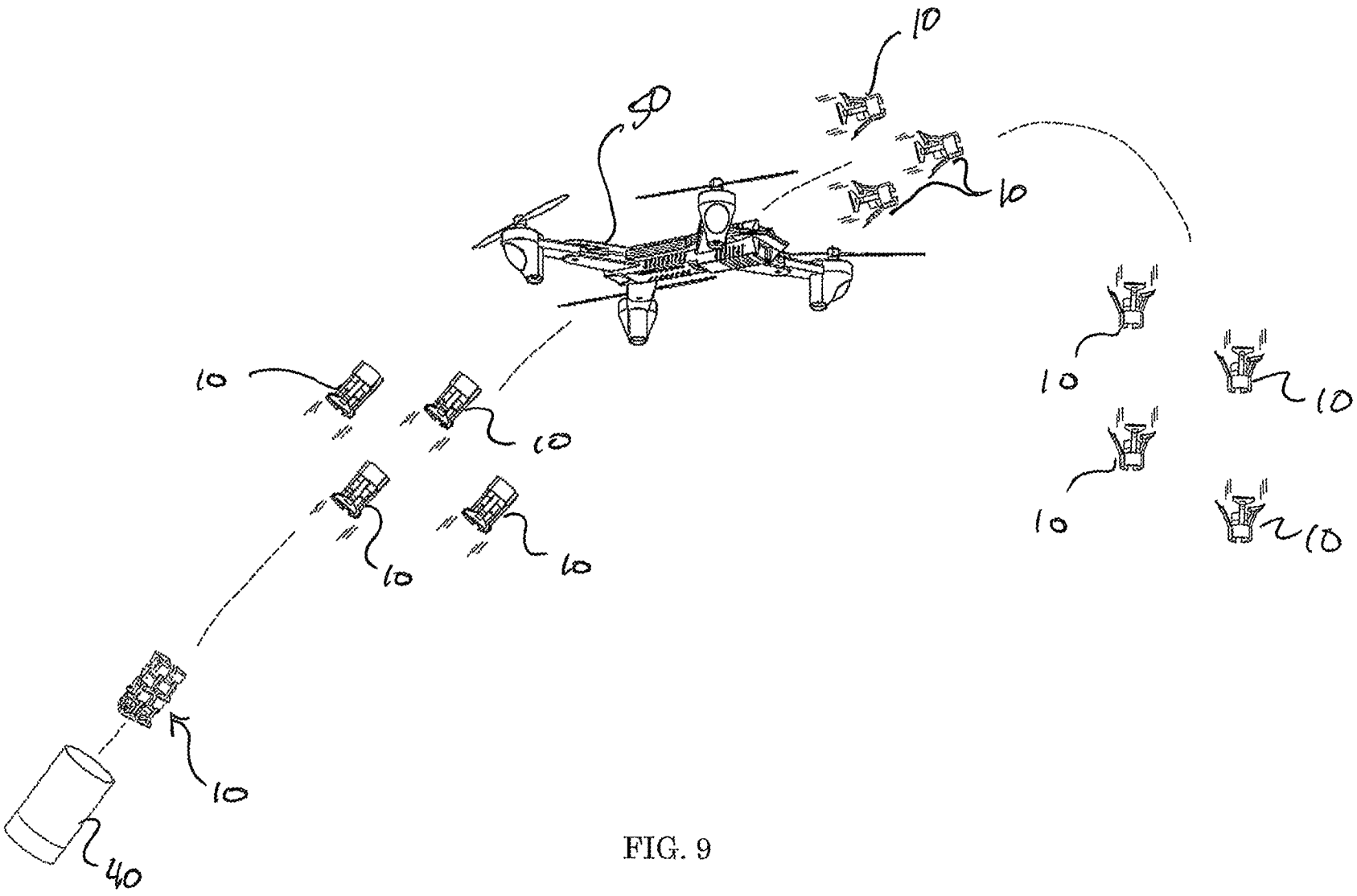
FIG. 9 is a diagrammatic sequential view illustrating discharge of the projectiles from a casing, flight toward a drone, impact with the drone, unfolding of wings, and safe descent of the projectiles.

Referring now to FIG. 9, a sequential diagrammatic view illustrates the operation of the projectile system from discharge to descent. At the left of the figure, a casing 40 is shown containing stacked projectiles 10 as previously described.

Upon firing, a sabot 42 drives the projectiles 10 from the casing 40. The projectiles initially travel with their wings 14 in the folded configuration, providing a streamlined profile suitable for stable flight toward a target.

As shown in the next stage, projectiles 10 advance toward an airborne drone. Some of the projectiles 10 strike the drone to disable or impair its operation, while others may continue beyond the strike zone. After a period of flight, wings 14 of the projectiles 10 unfurl from the folded configuration into the extended configuration.

In the extended state, the blade portions 22 of the wings 14 generate aerodynamic drag and impart autorotation to the body 12 of each projectile. This combination slows and stabilizes the descent of the projectiles 10. At the final stage, the projectiles are shown descending with wings 14 fully unfurled, thereby reducing terminal velocity and limiting the risk of injury or damage upon ground impact.

Although FIG. 9 illustrates a representative sequence with a drone target and a single discharge event, the invention is not limited to this depiction. In alternative embodiments, the projectiles may be launched from other types of casings or firing systems, may target different aerial devices, or may incorporate variations in wing deployment timing, range, or descent dynamics, as described herein.

The foregoing description of embodiments has been provided for purposes of illustration and is not intended to be exhaustive or to limit the invention to the precise forms disclosed, unless otherwise specified. Many modifications and variations will be apparent to those of ordinary skill in the art in light of the teachings herein. For example, while the projectiles have been described with three wings, other numbers of wings may be used, and the wings may be equally or unequally spaced. Likewise, while grooves and recesses have been described for stacking, alternative interlocking or alignment features may be employed. The ammunition round may include a single array of projectiles, multiple arrays separated by sabots or spacers, or different patterns of stacking, such as linear, square, or radial arrangements. The figures are provided to aid in understanding the inventive concepts and are not intended to limit the scope of the invention. The appended claims define the scope of the invention.

What is claimed is:

1. A projectile configured to be discharged from a firearm or launching device for disabling an airborne drone, the projectile comprising:

a penetrator body configured for flight toward the airborne drone;

a plurality of wings coupled to and spaced circumferentially around the penetrator body, each wing comprising an elongated arm portion having a first end attached to the penetrator body and a second end, free end;

wherein the plurality of wings are in a folded configuration during firing of the projectile and are configured to unfurl to an extended configuration after discharge;

wherein, in the extended configuration, the blade portions decelerate the projectile during descent and impart rotational motion to the penetrator body;

wherein the penetrator body has a forward end and a rearward end, the forward end having a greater diameter than the rearward end; and wherein the forward end includes a recess configured to receive the rearward end of another projectile in a stacked arrangement.

2. The projectile of claim 1, wherein the penetrator body further includes a plurality of longitudinal grooves extending from the forward end toward the rearward end; and wherein the grooves are configured to receive elongated arm portions of wings of another projectile stacked with the penetrator body.

3. The projectile of claim 1, wherein the plurality of wings are overmolded to the penetrator body.

4. The projectile of claim 1, wherein the second end of the elongated arm portion terminates in a widened blade portion.

5. The projectile of claim 4, wherein the widened blade portion is contoured to generate aerodynamic drag and induce autorotation.

6. An ammunition round comprising:

a casing;

a plurality of projectiles stacked within the casing, each projectile comprising:

a penetrator body configured for flight toward the airborne drone;

a plurality of wings coupled to and spaced circumferentially around the penetrator body, each wing comprising an elongated arm portion having a first end attached to the penetrator body and a second end, free end;

wherein the plurality of wings are in a folded configuration during firing of the projectile and are configured to unfurl to an extended configuration after discharge;

wherein, in the extended configuration, the blade portions decelerate the projectile during descent and impart rotational motion to the penetrator body;

wherein the penetrator body has a forward end and a rearward end, the forward end having a greater diameter than the rearward end;

wherein the forward end includes a recess configured to receive the rearward end of another projectile in a stacked arrangement;

the penetrator body further including a plurality of longitudinal grooves formed around a circumference of the penetrator body; and wherein the elongated arm portions of wings of one projectile are received in the grooves of another projectile in a stacked arrangement, such that the plurality of projectiles nest together in the casing.

7. The ammunition round of claim 6, further comprising a sabot positioned adjacent to a rearward end of the plurality of projectiles, the sabot including a plurality of nubs extending toward the projectiles, the nubs being positionable between folded wings of the projectiles and configured to contact rearward ends of the penetrator bodies so as to transmit firing force through the penetrator bodies.

8. The ammunition round of claim 6, wherein the plurality of projectiles are arranged in stacks, each stack comprising at least two projectiles.

9. The ammunition round of claim 6, wherein the wings of each projectile are in a folded configuration when nested within the casing.

10. The ammunition round of claim 6, wherein the wings of the projectiles are overmolded to the penetrator body.

11. The ammunition round of claim 6, wherein the widened blade portion is contoured to generate aerodynamic drag and induce autorotation.

12. A projectile configured to be discharged from a firearm or launching device for disabling an airborne drone, the projectile comprising:

a penetrator body having a forward end of greater diameter than a rearward end, the forward end including a recess, the rearward end being sized to be received in the recess of another projectile;

a plurality of longitudinal grooves formed through an outer surface of the forward end and extending toward the rearward end;

a plurality of wings circumferentially spaced around the body, each wing positioned between adjacent grooves, each wing including an elongated arm portion extending along the body and terminating in a free end; and wherein the wings are folded against the body in a stowed configuration and are configured to unfurl after discharge into an extended configuration.

13. The projectile of claim 12, wherein the elongated arm portions of wings of one projectile are received within the grooves of another projectile when stacked in series.

14. The projectile of claim 13, wherein the rearward end has a reduced diameter sized to provide clearance for blade portions of wings of an adjacent stacked projectile.

15. The projectile of claim 14, wherein the wings are overmolded onto the body.

16. The projectile of claim 15, wherein the wings are three in number and equally spaced circumferentially around the body.

17. The projectile of claim 12, wherein the free end of each blade has a widened blade portion and where in the widened blade portion is shaped to generate an aerodynamic drag and impart autorotation to the body during decent.

* * * * *